US007987636B2

(12) United States Patent
Hunt

(10) Patent No.: US 7,987,636 B2
(45) Date of Patent: Aug. 2, 2011

(54) TRUSS SEAT AND ANCHOR STRAP ASSEMBLY

(75) Inventor: Andrew Paschal Hunt, McKinney, TX (US)

(73) Assignee: Simpson STrong-Tie Company, Inc., Pleasanton, CA (US)

( * ) Notice: Subject to any disclaimer, the term of this patent is extended or adjusted under 35 U.S.C. 154(b) by 212 days.

(21) Appl. No.: 12/347,976

(22) Filed: Dec. 31, 2008

(65) Prior Publication Data

US 2010/0162638 A1 Jul. 1, 2010

(51) Int. Cl.
*E04B 7/04* (2006.01)

(52) U.S. Cl. ..... 52/92.2; 52/93.2; 52/699; 52/713; 52/710; 52/295

(58) Field of Classification Search ..... 52/92.2, 52/92.1, 707, 710, 715, 93.2, 699, 713, 702, 52/127.3, 370, 295, 698, 296, 649.1, 677
See application file for complete search history.

(56) References Cited

U.S. PATENT DOCUMENTS

| | | | | | |
|---|---|---|---|---|---|
| 1,423,991 | A | | 7/1922 | Brooks | |
| 1,699,557 | A | * | 1/1929 | Yeager | 52/365 |
| 1,751,785 | A | * | 3/1930 | Awbrey | 52/365 |
| 1,945,925 | A | | 2/1934 | Stiefel | |
| 2,013,101 | A | | 9/1935 | Inglee | |
| 2,110,863 | A | * | 3/1938 | Barnett | 52/101 |
| 2,182,579 | A | | 12/1939 | Bolton et. al. | |
| 2,191,979 | A | * | 2/1940 | Bierbach | 52/370 |
| 2,390,379 | A | | 12/1945 | Martin | |
| 2,467,115 | A | | 4/1949 | Duggan | |
| 2,947,119 | A | * | 8/1960 | Puckett, Jr. | 52/699 |
| 3,000,145 | A | * | 9/1961 | Fine | 52/699 |
| 3,422,585 | A | * | 1/1969 | Dismukes | 52/127.3 |
| 3,889,441 | A | | 6/1975 | Fortine | |
| 3,998,026 | A | | 12/1976 | Allen | |
| 4,096,677 | A | | 6/1978 | Gilb | |
| 4,199,908 | A | | 4/1980 | Teeters | |
| 4,329,826 | A | | 5/1982 | Flogaus et al. | |
| 4,404,781 | A | | 9/1983 | Gilb | |
| 4,410,294 | A | | 10/1983 | Gilb | |
| 4,413,456 | A | | 11/1983 | Gilb | |
| 4,449,335 | A | | 5/1984 | Fahey | |
| D278,028 | S | | 3/1985 | Fleishman | |

(Continued)

OTHER PUBLICATIONS

Nu-Vue Industries, Inc. Web Page, NV358 14G Nvth Straps—with 2 ply 18G Seat., Feb. 13, 2008, p. 1 of 1.

(Continued)

*Primary Examiner* — Basil Katcheves
*Assistant Examiner* — Branon C Painter
(74) *Attorney, Agent, or Firm* — James R. Cypher; Charles R. Cypher

(57) ABSTRACT

A seat and anchor assembly for mounting and securing a wood joist or roof truss to a tie beam of a building including a central web portion and an upwardly extending wall portion disposed along a longitudinal edge thereof wherein a lower portion of the roof truss or joist fits within what may be considered a seat defined by the web and the upstanding wall portion. An elongated anchor strap is adjustably attached to the wall portion and is adapted to be secured by nails or like connectors to the top portion of the roof truss and further wherein the anchor strap includes a lower length disposed and adapted to be embedded in wet concrete initially defining the tie beam of the building on which the seat and truss rests.

9 Claims, 6 Drawing Sheets

U.S. PATENT DOCUMENTS

| | | | | | |
|---|---|---|---|---|---|
| 4,527,375 | A | | 7/1985 | Braginetz | |
| 4,885,884 | A | * | 12/1989 | Schilger | 52/354 |
| 4,910,934 | A | | 3/1990 | Hennings | |
| 4,920,725 | A | | 5/1990 | Gore | |
| 4,924,648 | A | | 5/1990 | Gilb et al. | |
| 4,932,173 | A | | 6/1990 | Commins | |
| 4,995,206 | A | | 2/1991 | Colonias et al. | |
| 5,109,646 | A | | 5/1992 | Colonias et al. | |
| 5,150,553 | A | | 9/1992 | Commins et al. | |
| 5,230,198 | A | * | 7/1993 | Callies | 52/702 |
| 5,253,465 | A | | 10/1993 | Gilb | |
| 5,307,603 | A | * | 5/1994 | Chiodo | 52/698 |
| 5,335,469 | A | | 8/1994 | Stuart | |
| 5,335,470 | A | | 8/1994 | Alvarez | |
| 5,357,721 | A | | 10/1994 | Alvarez | |
| 5,375,384 | A | | 12/1994 | Wolfson | |
| 5,380,115 | A | | 1/1995 | Colonias | |
| 5,442,887 | A | * | 8/1995 | Welsh | 52/92.2 |
| 5,595,031 | A | | 1/1997 | Commins | |
| 5,699,639 | A | | 12/1997 | Fernandez | |
| 5,813,182 | A | | 9/1998 | Commins | |
| 6,560,943 | B1 | | 5/2003 | Leek et al. | |
| 7,254,919 | B2 | * | 8/2007 | Lutz et al. | 52/92.2 |
| 7,448,171 | B1 | * | 11/2008 | diGirolamo et al. | 52/92.2 |

OTHER PUBLICATIONS

USP Structural Connectors, 2007, pp. 158-161.

Simpson Strong Tie Company, Inc. Catalog C-2008, Dec. 2007, Masonry Connectors, 2 pages.

Simpson Strong-Tie Company Web Pages, META/HETA, HHETA/HETAL/ TSS, Feb. 25, 2007, p. 1 of 5.

Hughes Manufacuring, Inc. Catalog. Wood to Masonry to Wall, 1 page.

Hughes Manufacturing, Inc. Product Catalog, p. 31, published at least as early as 1994 and is prior art, Hughes Manufacturing, Inc., Largo, Florida.

Southeastern Metals Product Catalog, pp. 26 and 27, published at least as early as 1994 and is prior art, Southeastern Metals, Jacksonville, Florida.

Connectors for the Plated Truss Industry, Product & Instruction Manual, 1993, pp. 23, 25, 28 and cover page, C-PT94-1, Simpson Strong-Tie Company, Inc., Pleasanton, California.

Hughes Manufacturing, Inc. Product Catalog, pp. 6, 7, 9, 21, 34, 35, 36, 41, 42 and cover pages, 1997, Hughes Manufacturing, Inc., Largo, Florida.

Connectors for Wood Construction, Product & Instruction Manual, 1993, pp. 8, 9, 12, 17, 18, 19, 22, 23, 24 and cover page, C-94H-1, Simpson Strong-Tie Company, Inc., Pleasanton, California.

* cited by examiner

TRUSS SEAT AND ANCHOR STRAP ASSEMBLY

BACKGROUND OF THE INVENTION

Truss seats and anchor assemblies are well known in the art for anchoring trusses to concrete walls. Many such truss seats have a web upon which the truss sits that serves as a barrier to keep the wood of the truss or joist out of contact with the upper surface of the concrete protecting it from moisture.

Anchors often come in the form of elongated straps that may work in conjunction with the seat or alone. In use, a lower end of the anchor strap is embedded in the concrete of the tie beam when wet and an upper end is bent over the roof truss or wood joist so that headed nails can be passed through the anchor strap on opposite sides of the roof truss or wood joist.

One feature of securing the anchor straps to the truss seats or channels is that it maintains the assembly conveniently together until installed. In such an instance the straps can be secured to the channel by means of a rivet.

In a hurricane, it has been found that there is often a failure of the connection of the roof truss to the concrete wall, primarily due to the generally upwardly directed forces causing the roof to fly upwardly away from the tie beam or wall.

Some anchor and seat assemblies use two anchor straps riveted or otherwise adjustably connected in spaced longitudinal relation to one another with respect to the central web of the seat. Some anchor and seat assemblies are made with a channel-shaped seat.

SUMMARY OF THE INVENTION

The present invention improves on the prior art moisture barrier truss seats be improving the interface with the underlying concrete. This is accomplished by forming an improved embedment leg that has a pair of angularly-related portions that increase the surface area embedded in the concrete and provide flat faces to resist movement in four directions.

This invention is of a truss seat and anchor assembly comprising a channel length with a central web portion and upstanding spaced and substantially parallel side walls to cradle a truss and wherein two anchor straps are provided which are adjustably connected to the wall portion in longitudinally spaced relation to one another. One anchor strap is connected to one of the wall portions of the channel length and the other anchor strap is spaced longitudinally from the first anchor strap and is connected to the other of the wall portions.

The assembly can easily be transported to a job site for use in anchoring the trusses in spanning relation to walls each having an upper peripheral tie beam. At a job site, since there are often numerous workmen at a given time, if there are not enough anchor straps or alternatively, not enough channel lengths, the job is shut down and a run must be made to secure an additional supply of channel lengths or anchor straps. This invention is of an assembly wherein the two anchor straps are pre-attached to the channel by rivets or other adjustable means at spaced predetermined positions along the length of the web portion of the channel. Such attachments are provided so that delays and job shut downs are avoided as set forth above. Also, such attachments of the anchor straps to the wall portion provide predetermined spacing of the anchor straps to assure additional resistance to upward forces without fear of fracture of the wood material of the truss when nails are applied thereto.

DETAILED DESCRIPTION OF THE INVENTION

Figure 1:
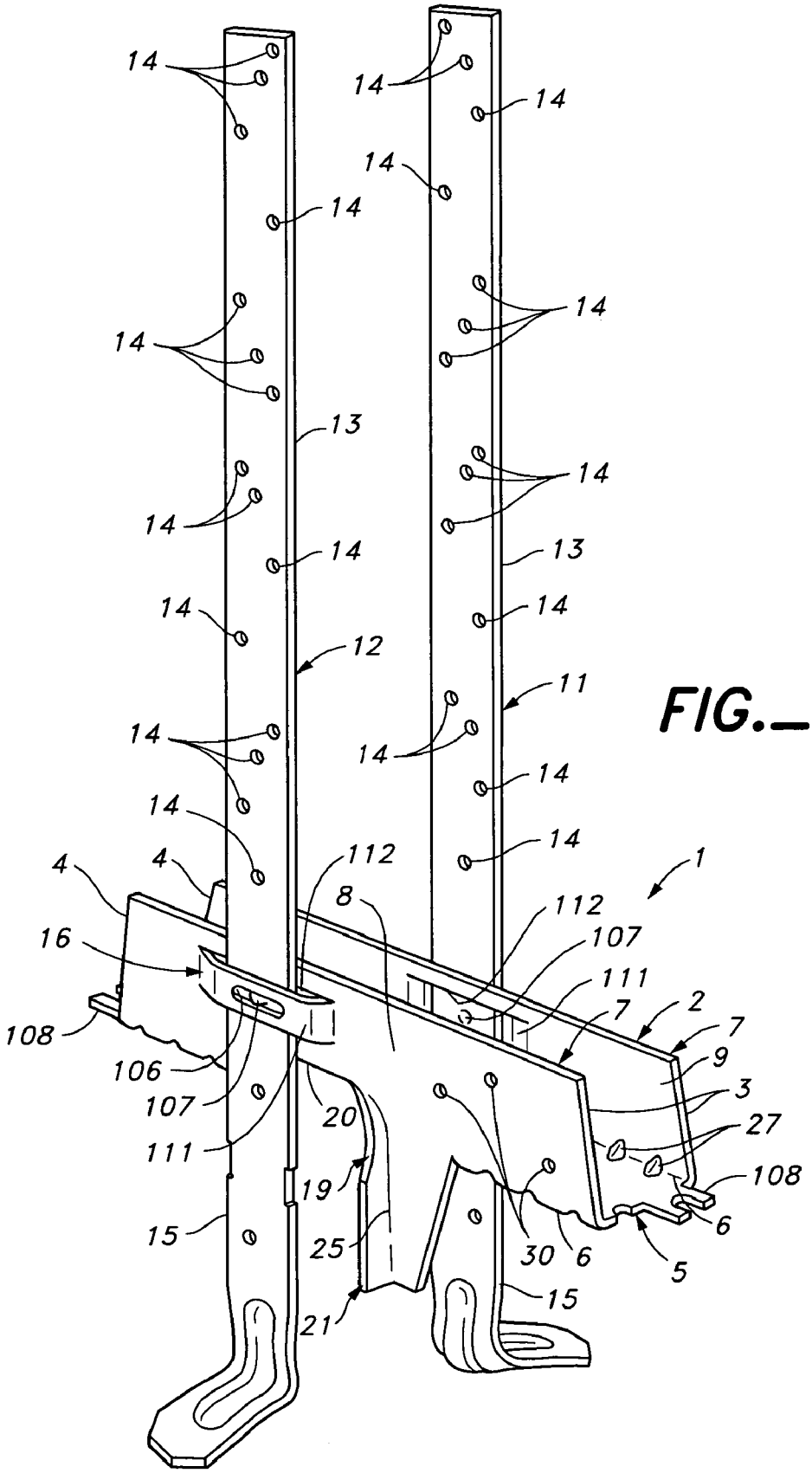
FIG. 1 is a perspective view of the anchor strap assembly of the present invention.
Figure 2:
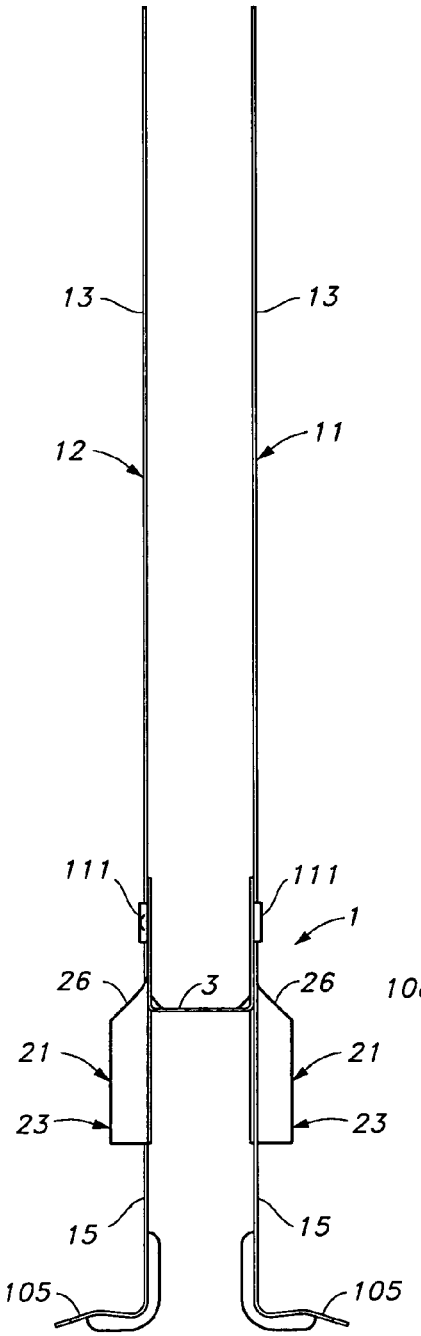
FIG. 2 is a front elevation view of the anchor strap assembly of the present invention.
Figure 3:
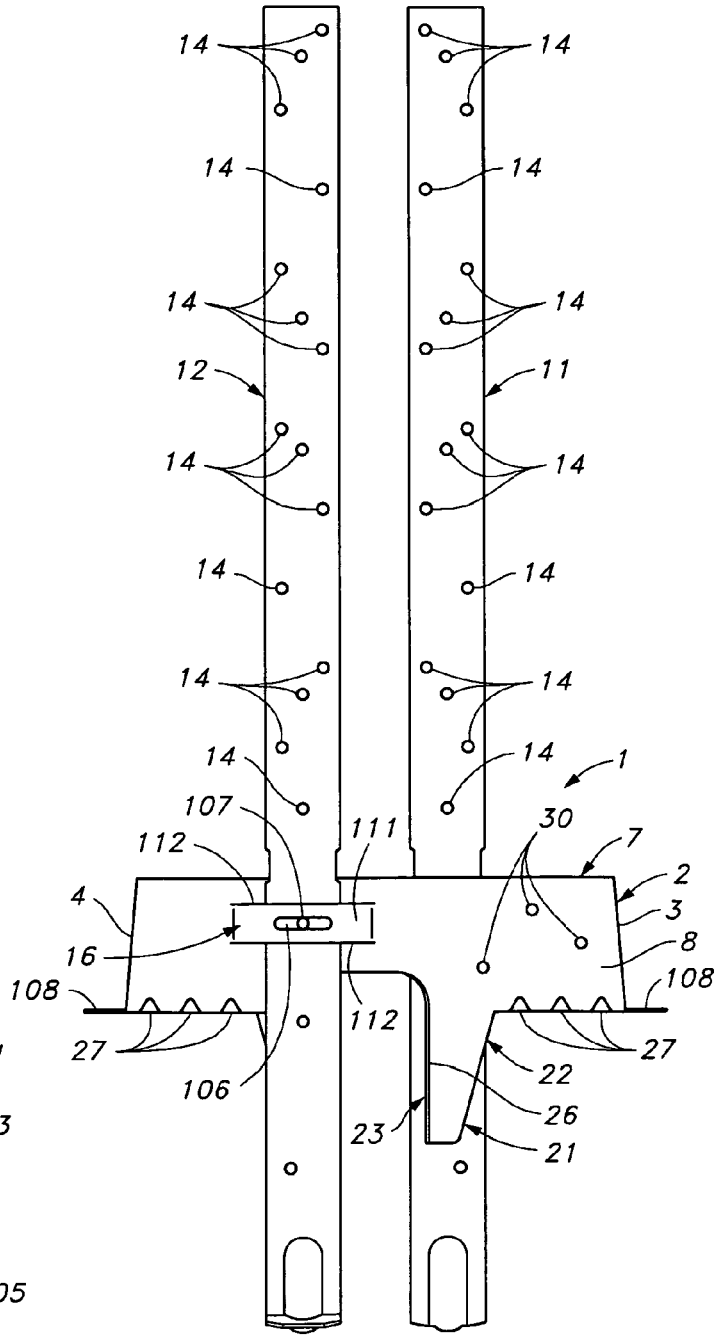
FIG. 3 is a side elevation view of the anchor strap assembly of the present invention.
Figure 4:
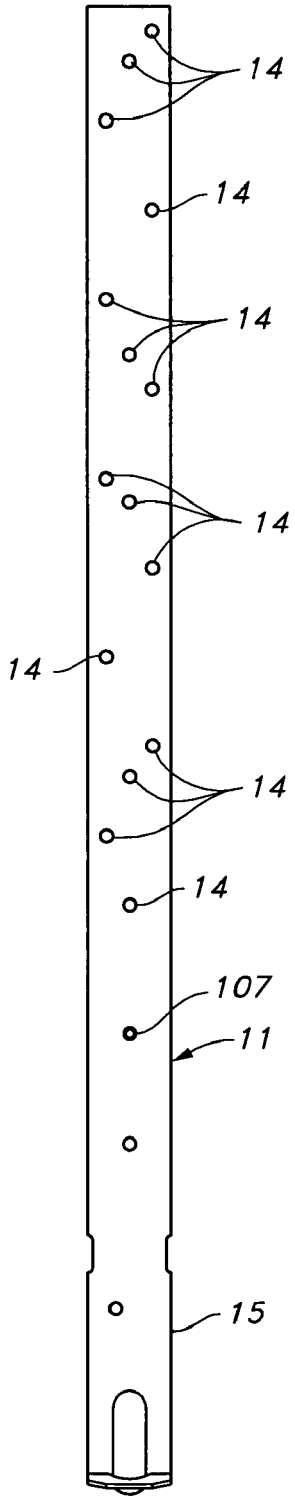
FIG. 4 is a front elevation view of the anchor strap of the present invention.
Figure 5:
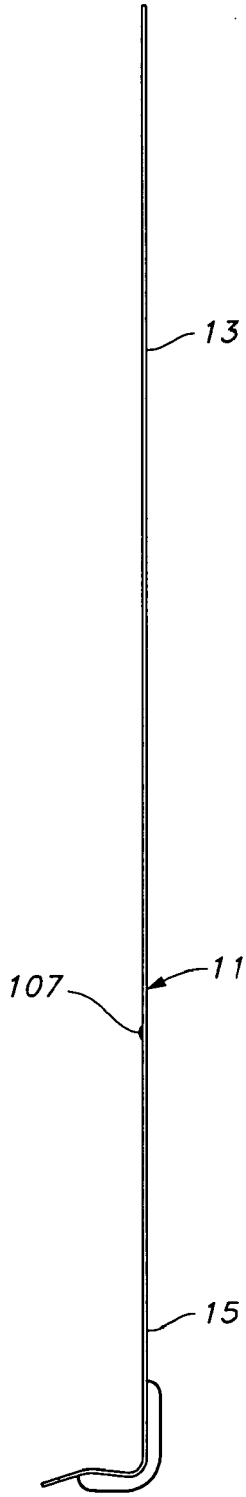
FIG. 5 is a side elevation view of the anchor strap of the present invention.
Figure 6:
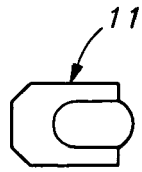
FIG. 6 is a bottom plan view of the anchor strap of the present invention.
Figure 7:
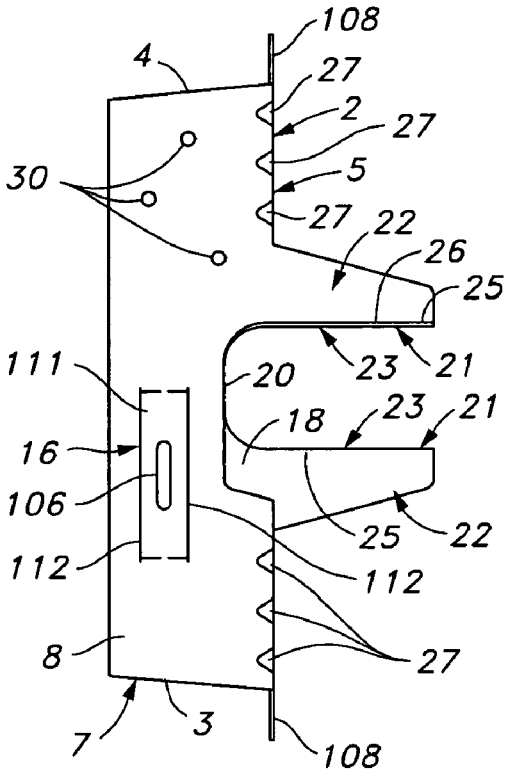
FIG. 7 is a side elevation view of the channel length of the present invention.
Figure 8:
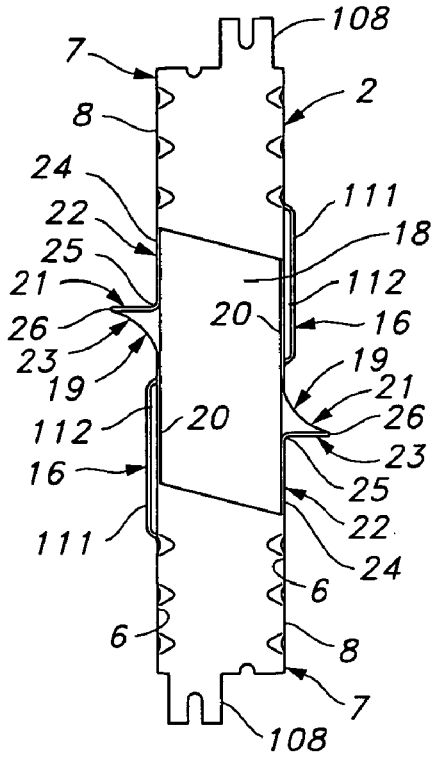
FIG. 8 is a bottom plan view of the channel length of the present invention.
Figure 9:
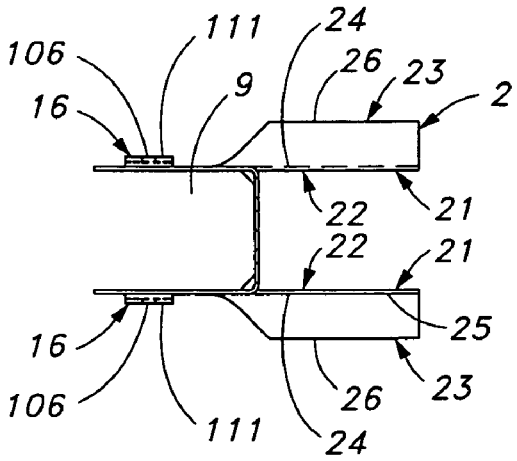
FIG. 9 is an end elevation view of the channel length of the present invention.

The present invention is an improved truss seat and anchor strap assembly 1. In its simplest form, the improved truss seat and anchor strap assembly comprises an angle length 2, a first elongate anchor strap 11, and a first connection means 16.

The angle length 2 has a first end 3 and a second end 4, and an underlayment portion 5. The underlayment portion 5 has a first longitudinally extending edge 6 with a first wall portion 7 secured to it. The first wall portion 7 has an outer surface 8 facing away from the underlayment portion 5. The first wall portion 7 extends longitudinally along the first edge 6 and extends upwardly from the underlayment portion 5 to define a truss support 9 therebetween. The truss support 9 is adapted to receive a truss 10 on the underlayment portion 5 and beside the first wall portion 7.

The first elongate anchor strap 11 has an upper length 13 for fastening to the truss 10 and a lower length 15 adapted to be embedded in concrete. The first connection means 16 for connecting the first anchor strap 11 to the angle length 2 extends outwardly from the anchor strap 11 in generally perpendicular relation to the first wall portion 7 and extends through the first wall portion 7. The first anchor strap 11 is attached to the first wall portion 7 of the angle length 2. The upper length 13 of the first anchor strap 11 extends above the angle length 2 and the lower length 15 of the first anchor strap 11 extends below the angle length 2, when the first anchor strap 11 is in an operative position.

The angle length 2 has a first aperture 18 in the underlayment portion 5 and the first wall portion 7. The first aperture 18 traverses the first longitudinally extending edge 6 and has an edge 19 with an upper portion 20 in the first wall portion 7. The angle length 2 has a first embedment leg 21 that is adapted to be embedded in concrete and has a first extended portion 22 and a second extended portion 23. The first embedment leg 20 is formed from at least portion of the angle length 2 material removed to create the first aperture 18. The first extended portion 22 has an outer face 24 that extends from the outer surface 8 of the first wall portion 7. The first extended portion 22 projects from, is integrally joined to, and is at least partially co-planar with the first wall portion 7. The second extended portion 23 is angularly related, and integrally joined, to the first extended portion 22 along a first angular juncture 25. The second extended portion 23 has an outer edge 26 at least partially opposite the first angular juncture 25. The outer edge 26 and the first angular juncture 25 converges toward the upper portion 20 of the edge 19 of the first aperture 18 in the first wall portion 7. The outer edge 26 of the second extended portion 23 twists to join the upper portion 20 of the edge 19 of the first aperture 18 in the first wall portion 7, forming a continuous edge.

Preferably, the angle length 2 is a channel length 2 and the underlayment portion 5 is a central web portion 5. Preferably, the central web portion 5 has a second longitudinally extending edge 6 parallel to the first longitudinally extending edge 6. Preferably, a second wall portion 7 with an outer surface 8 is secured to the second longitudinally extending edge 6 in generally parallel relation to the first wall portion 7 to define a truss cradle 9 therebetween. Preferably, the truss cradle 9 is adapted to receive a truss 10 on the central web portion 5 and between the wall portions 7 and 8.

Preferably, the anchor strap assembly 1 includes a second elongate anchor strap 12 with an upper length 13 for fastening to the truss 10 and a lower length 15 adapted to be embedded in concrete.

The anchor strap assembly 1 preferably includes a second connection means 16 for connecting the second anchor strap 12 to the channel length 2. The second connection means 16 extends outwardly in generally perpendicular relation to the second wall portion 7 from the anchor strap 12 and extends through the second wall portion 7.

Preferably, the second anchor strap 12 is attached to the second wall portion 7 of the channel length 2. The upper length 13 of the second anchor strap 12 preferably extends above the channel length 2 and the lower length 14 of the second anchor strap 12 extends below the channel length 2 when the second anchor strap 12 is in an operative position.

The first aperture 2 preferably extends into the second wall portion 7. Preferably, the first aperture 2 traverses the second longitudinally extending edge 6, the edge 19 of the first aperture 2 having an upper portion 20 in the second wall portion 7. The angle length 2 preferably has a second embedment leg 21 that is adapted to be embedded in concrete and has a first extended portion 22 and a second extended portion 23. Preferably, the second embedment leg 21 is formed from at least portion of the channel length 2 material removed to create the first aperture 18. The first extended portion 22 preferably has an outer face 24 that extends from the outer surface 8 of the second wall portion 7. Preferably, the first extended portion 22 projects from, is integrally joined to, and is at least partially co-planar with the second wall portion 7. The second extended portion 23 preferably is angularly related, and integrally joined, to the first extended portion 22 along a first angular juncture 25. Preferably, the second extended portion 23 has an outer edge 26 at least partially opposite the first angular juncture 25. The outer edge 26 and the first angular juncture 25 preferably converge toward the upper portion 20 of the edge 19 of the first aperture 18 in the second wall portion 7. Preferably, the outer edge 26 of the second extended portion 23 twists to join the upper portion 20 of the edge 19 of the first aperture 18 in the second wall portion 7, forming a continuous edge.

Figure 11:
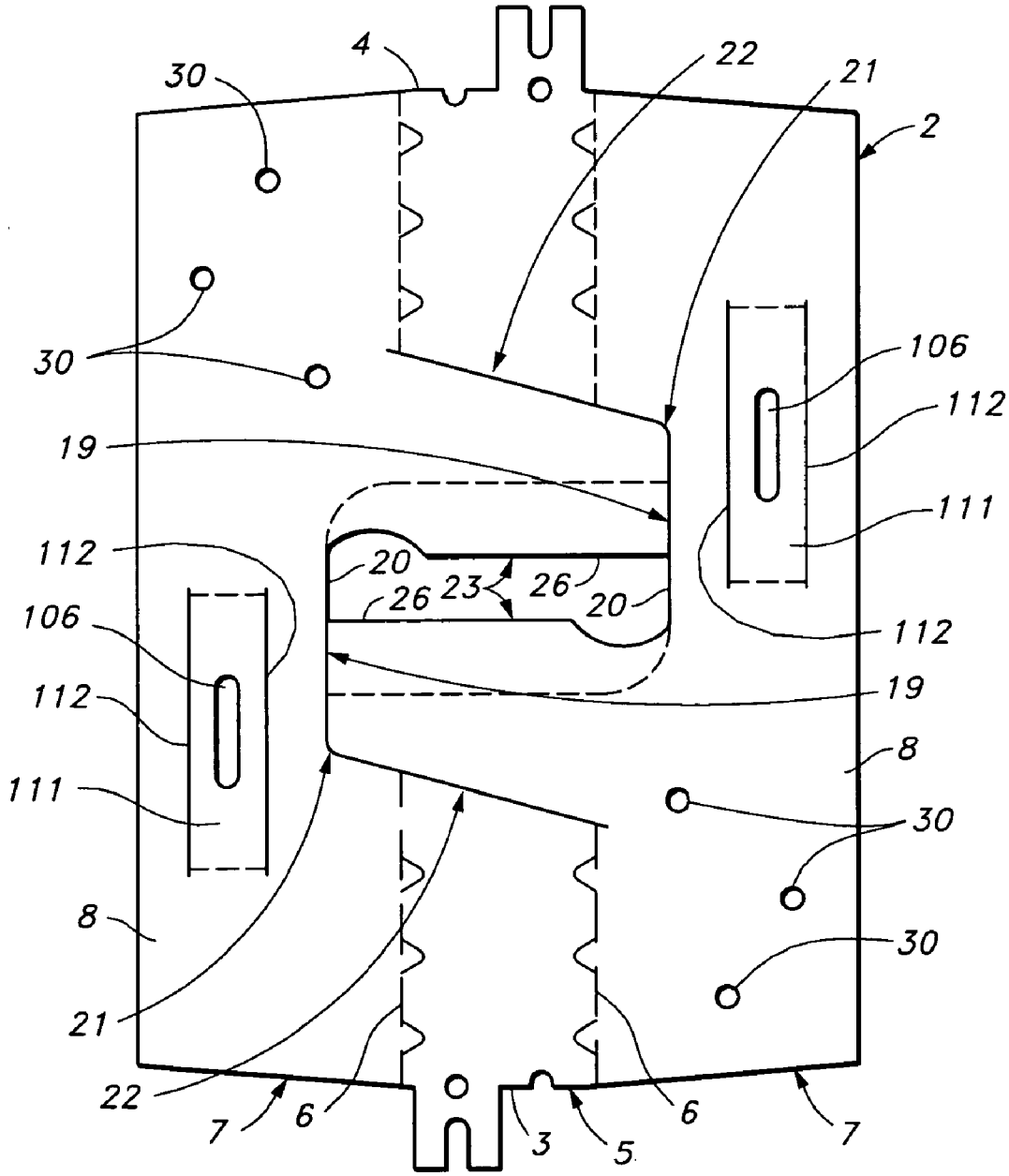
FIG. 11 is a plan view of the sheet metal blank of the channel length of the present invention.

As shown in FIG. 11, the channel length 2 is cut from a flat sheet metal blank. Fastener openings 30 are drilled or punched through the first and second wall portions 7, preferably three in each and preferably offset at opposite ends of the first and second wall portions 7. When the first and second wall portions 7 are bent up along the first and longitudinally extending parallel edges 6 of the channel length 2, the first and second embedment legs 21 are simulataneously bent down, forming the first aperture 18. The preferred connection means 16 are strips or fingers 111 cut lengthwise from the first and second wall portions 7 by means of two slits 112, each bent out so that an anchor strap 11 or 12 can be slipped between the connection means 16 and the outer surface 8 of a wall portion 7 in combination with a dimple 107 on the anchor strap 11 or 12 that interfaces with the longitudinal slot 106 preferably formed in the connection means 16 to hold the anchor strap 11 or 12 in place before it is fastened to the truss 10.

Figure 10:
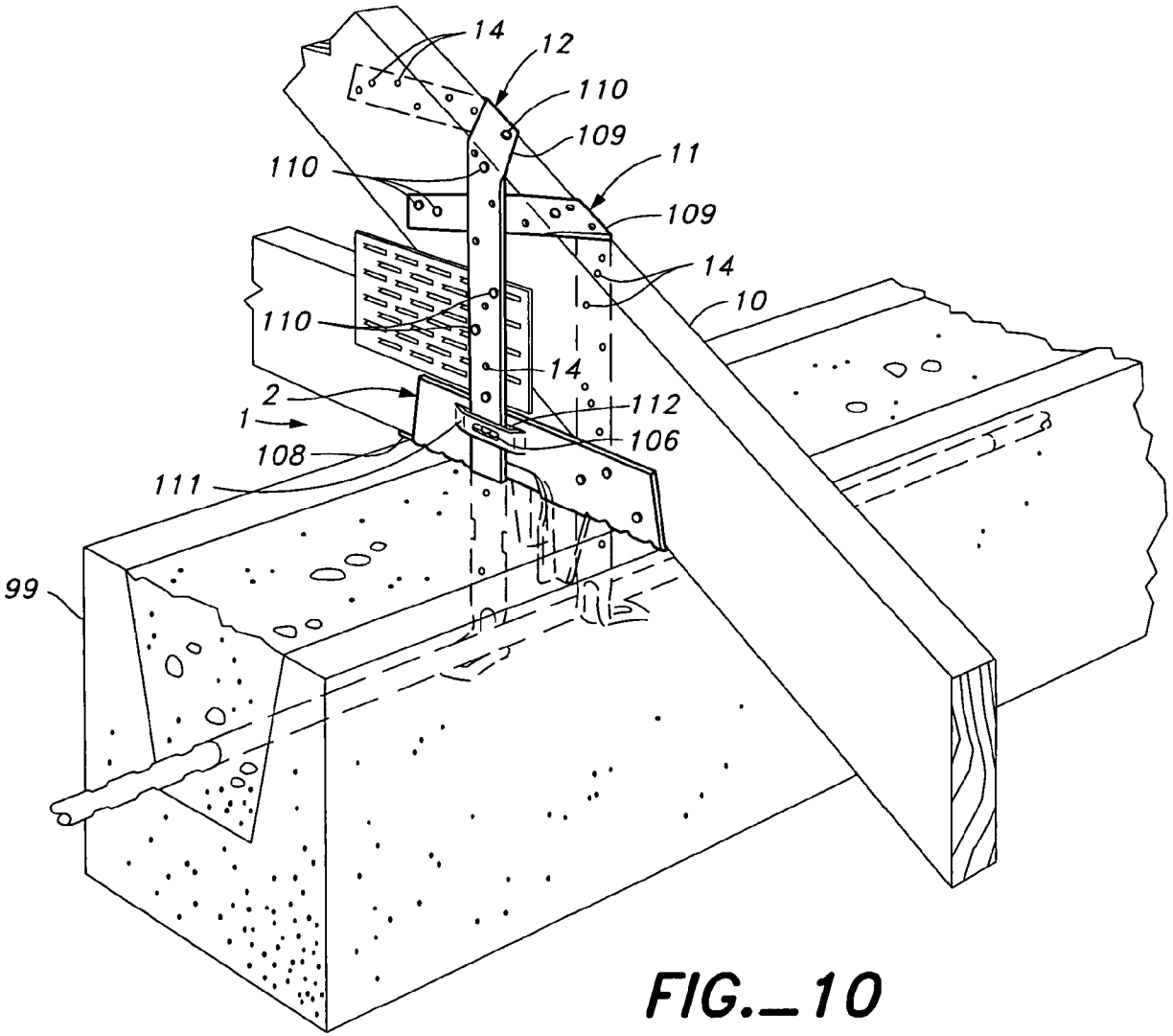
FIG. 10 is a perspective view of the anchor strap assembly connection of the present invention.

As shown in FIG. 10, the purpose of the truss seat and anchor strap assembly 1 is to adequately position an secure a roof truss 10 in an anchored relation to a tie beam 99. The tie beam 99 is preferably formed from concrete, but another form of masonry or, in fact, any other material in which the truss seat and anchor strap assembly can be embedded, is possible. The anchor straps 11 and 12 and the embedment legs 21 are embedded within the tie beam 99 while the concrete is still wet and penetrable. In the preferred embodiment, the anchor straps 11 ans 12 are formed with openings 14 that receive fasteners 110 that are driven into the roof truss 10.

Preferably, the first and second longitudinally extending edges 6 are reinforced by one or more gussets 27. The central web portion 5 preferably has a fastener extension 108 at each of the first end 3 and the second end 4.

Preferably, the lower length 15 of each of the first and second anchor straps 11, 12 includes a terminal end zone or foot 105 and the terminal end zone or foot 105 of each of the first and second anchor straps 11, 12 is bent out of the plane of the upper length 13 of a respective anchor strap 11, 12 when the first and second anchor straps 11, 12 are in an operative position.

The central web portion 5 preferably is disposed beneath and in supporting relation to a truss 10 and in supported engagement on a tie beam 99. Preferably, the tie beam 99 is initially defined by the wet concrete in which the lower length 15 of each of the first and second anchor straps 11, 12 are embedded.

Each of the first and second wall portions 7 preferably includes an elongate adjustment slot 106 formed therein at a juncture of each anchor strap 11, 12 and a respective wall portion 7 to which it is adjustably attached. Preferably, each of the first and second anchor straps 11, 12 has a dimple 107 that extends through respective wall portions 7 and through the elongate adjustment slots 106.

Preferably, the channel length 2 is cold formed from 18 gauge G185 galvanized steel.

I claim:

1. An improved truss seat and anchor strap assembly (1) comprising:

(a) an angle length (2) having a first end (3) and a second end (4), an underlayment portion (5) with a first longitudinally extending edge (6) having a first wall portion (7) secured thereto, said first wall portion (7) having an outer surface (8) facing away from said underlayment portion (5), said first wall portion (7) extending longitudinally along said first edge (6) and extending upwardly from said underlayment portion (5) to define a truss support (9) therebetween, said truss support (9) adapted to receive a truss (10) on said underlayment portion (5) and beside said first wall portion (7);

(b) a first elongate anchor strap (11) having an upper length (13) for fastening to said truss (10) and a lower length (15) adapted to be embedded in concrete;

(c) said first anchor strap (11) being attached to said angle length (2);

(d) said upper length (13) of said first anchor strap (11) extending above said angle length (2) and said lower length (15) of said first anchor strap (11) extending below said angle length (2) when said first anchor strap (11) is in an operative position;

(e) a first aperture (18) in said underlayment portion (5) and said first wall portion (7), said first aperture (18) traversing said first longitudinally extending edge (6), said first aperture (18) having an edge (19) with an upper portion (20) in said first wall portion (7); and (f) a first embedment leg (21) adapted to be embedded in concrete having a first extended portion (22) and a second extended portion (23), wherein:

(i) said first embedment leg (20) is formed from at least portion of the angle length (2) material removed to create said first aperture (18);

(ii) said first extended portion (22) has an outer face (24) that extends from said outer surface (8) of said first wall portion (7);

(iii) said first extended portion (22) projects from, is integrally joined to, and is at least partially co-planar with said first wall portion (7);

(iv) said second extended portion (23) is angularly related, and integrally joined, to said first extended portion (22) along a first angular juncture (25);

(v) said second extended portion (23) has an outer edge (26) at least partially opposite said first angular juncture (25), said outer edge (26) and said first angular juncture (25) converging toward said upper portion (20) of said edge (19) of said first aperture (18) in said first wall portion (7); and (vi) said outer edge (26) of said second extended portion (23) twists to join said upper portion (20) of said edge (19) of said first aperture (18) in said first wall portion (7), forming a continuous edge.

2. The improved truss seat and anchor strap assembly (1) of claim 1, wherein:

a) said angle length (2) is a channel length (2) and said underlayment portion (5) is a central web portion (5) having a second longitudinally extending edge (6) parallel to said first longitudinally extending edge (6) and a second wall portion (7) having an outer surface (8) secured to said second longitudinally extending edge (6) in generally parallel relation to said first wall portion (7) to define a truss cradle (9) therebetween, said truss cradle (9) adapted to receive a truss (10) on the central web portion (5) and between said wall portions (7, 8);

b) a second elongate anchor strap (12) having an upper length (13) for fastening to said truss (10) and a lower length (15) adapted to be embedded in concrete;

c) said second anchor strap (12) being attached to said channel length (2);

(d) said upper length (13) of said second anchor strap (12) extending above said channel length (2) and said lower length (14) of said second anchor strap (12) extending below said channel length (2) when said second anchor strap (12) is in an operative position;

(e) said first aperture extends into said second wall portion, said first aperture travesring said second longitudinally extending edge (6), said edge of said first aperture having an upper portion in said second wall portion;

(f) a second embedment leg (22) adapted to be embedded in concrete having a first extended portion (19) and a second extended portion (20), wherein:

(i) said second embedment leg (22) is formed from at least portion of the channel length (2) material removed to create said first aperture (18);

(ii) said first extended portion (19) has an outer face (21) that extends from said outer surface (8) of said second wall portion (7);

(iii) said first extended portion (19) projects from, is integrally joined to, and is at least partially co-planar with said second wall portion (7);

(iv) said second extended portion (20) is angularly related, and integrally joined, to said first extended portion (19) along a first angular juncture (25);

(v) said second extended portion (20) has an outer edge (26) at least partially opposite said first angular juncture (25), said outer edge (26) and said first angular juncture (25) converging toward said upper portion (20) of said edge (19) of said first aperture (18) in said second wall portion (7); and (vi) said outer edge (26) of said second extended portion (20) twists to join said upper portion (20) of said edge (19) of said first aperture (18) in said second wall portion (7), forming a continuous edge.

3. The improved truss seat and anchor strap assembly (1) of claim 2, wherein:

(a) said first and second longitudinally extending edges (6) are reinforced by one or more gussets (27).

4. The improved truss seat and anchor strap assembly (1) of claim 3, wherein:

(a) said central web portion (5) has a fastener extension (108) at each of said first end (3) and said second end (4).

5. The improved truss seat and anchor strap assembly (1) of claim 2, wherein:

(a) said lower length (15) of each of said first and second anchor straps (11, 12) includes a terminal end zone (105) and the terminal end zone (105) of each of said first and second anchor straps (11, 12) is bent out of the plane of the upper length (13) of a respective anchor strap (11, 12) when said first and second anchor straps (11, 12) are in an operative position.

6. The improved truss seat and anchor strap assembly (1) of claim 2, wherein:

(a) said central web portion (5) is disposed beneath and in supporting relation to a truss (10) and in supported engagement on a tie beam (99).

7. The improved truss seat and anchor strap assembly (1) of claim 6, wherein:

(a) said tie beam (99) is initially defined by the wet concrete in which the lower length (15) of each of said first and second anchor straps (11, 12) are embedded.

8. The improved truss seat and anchor strap assembly (1) of claim 2, wherein:

(a) each of said first and second wall portions (7) includes an elongate adjustment slot (106) formed therein at a juncture of each anchor strap (11, 12) and a respective wall portion (7) to which it is adjustably attached.

9. The improved truss seat and anchor strap assembly (1) of claim 8, wherein:

(a) each of said first and second anchor straps (11, 12) has a dimple (107) that extends through respective wall portions (7) and through said elongate adjustment slots (106).

* * * * *